US006758145B1

(12) United States Patent
Hefter

(10) Patent No.: US 6,758,145 B1
(45) Date of Patent: Jul. 6, 2004

(54) TRACK CLEANER FOR MODEL RAILROADS

(76) Inventor: Henry Hefter, 107 Greenwood Dr., Temple, PA (US) 19560

( * ) Notice: Subject to any disclaimer, the term of this patent is extended or adjusted under 35 U.S.C. 154(b) by 0 days.

(21) Appl. No.: 10/429,585

(22) Filed: May 5, 2003

(51) Int. Cl.[7] ..... B61F 19/00
(52) U.S. Cl. ..... 104/279; 15/54; 105/1.5
(58) Field of Search ..... 104/279, DIG. 1; 105/238.2, 1.5; 15/56, 55, 97.1, 103.5, 265.5; 291/1, 3, 19, 20

(56) References Cited

U.S. PATENT DOCUMENTS

| | | | | | |
|---|---|---|---|---|---|
| 50,634 | A | | 10/1865 | Sharp | 104/279 |
| 195,217 | A | | 9/1877 | Isaacs | 104/279 |
| 2,475,771 | A | | 7/1949 | Wittner | 104/279 |
| D185,107 | S | * | 5/1959 | Van Dyck et al. | D34/15 |
| 3,103,897 | A | * | 9/1963 | Bonanno et al. | 104/279 |
| 5,060,335 | A | * | 10/1991 | Webster | 15/97.1 |
| 5,067,283 | A | * | 11/1991 | Pomikacsek | 451/347 |
| 5,816,168 | A | | 10/1998 | Poissant | 104/279 |
| 5,904,100 | A | | 5/1999 | Findley et al. | 104/279 |
| 6,536,355 | B1 | | 3/2003 | Amemiya | 105/1.5 |

FOREIGN PATENT DOCUMENTS

| | | | |
|---|---|---|---|
| DE | 2801111 | 3/1979 | 104/279 |

* cited by examiner

*Primary Examiner*—Frantz F. Jules
(74) *Attorney, Agent, or Firm*—Miller Law Group, PLLC

(57) ABSTRACT

A model railroad track cleaning car having a cleaning element suspended between a pair of wheeled trucks. The cleaning element is an abrasive material that is affixed to the underside of a weighted chassis that is suspended from a pair of articulating arms connected to the respective wheeled trucks. The cleaning material is easily replaced by removing a pair of fasteners from the chassis. A spring tension apparatus is positioned between the articulating arm and the cleaning element chassis to selectively position the cleaning element over the model railroad tracks. A retaining wire is captured in the articulating arm and engages the corresponding truck to turn the articulating arm with the truck, thus positioning the cleaning element over the model railroad tracks even when traversing a curve. A thumb wheel is formed with a notch that receives the articulating arm to lock the thumb wheel into a selected position.

20 Claims, 4 Drawing Sheets

Fig. 3
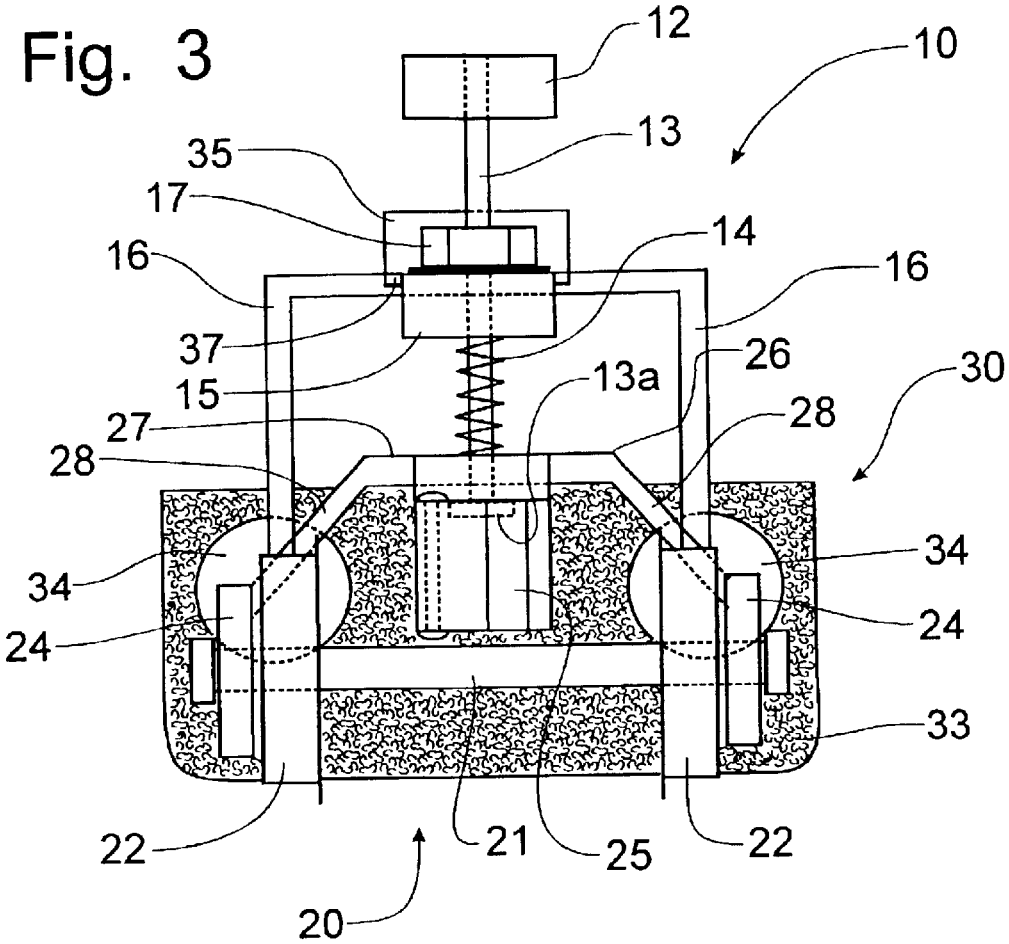
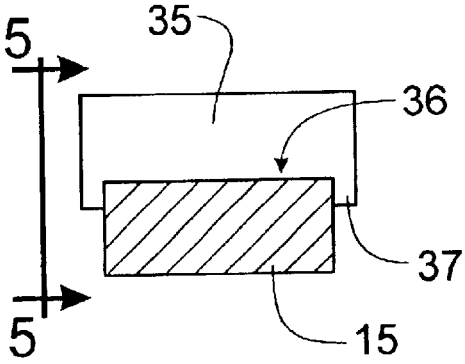
Fig. 4
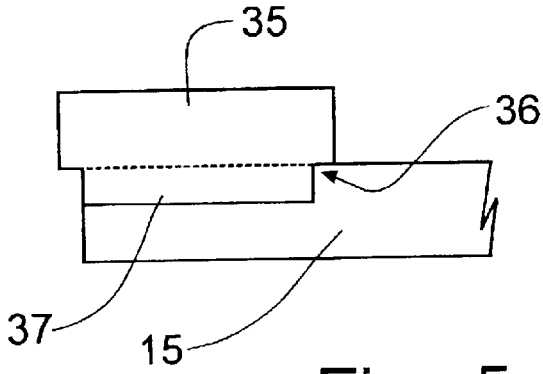
Fig. 5

TRACK CLEANER FOR MODEL RAILROADS

BACKGROUND OF THE INVENTION

This invention relates to the model railroads and, more particularly, to a device for cleaning the top surface of the tracks of a model railroad.

Model railroad sets operate electrically with the engine of the locomotive, or other powered car, receiving low voltage electrical current through the track into the wheels of the locomotive. When the tracks become dirty with oil, dust, oxidation, etc. the transmission of electrical current from the track into the locomotive wheels is hindered due to the lack of proper contact therebetween. Accordingly, it is often necessary to remove the oil and dirt from the top surface of the tracks to assure proper operation of the locomotive. One mode of cleaning the railroad tracks is to manually clean the surface of the tracks with appropriate cleaning material, usually wet with a cleaning solution, but this is a rather slow and laborious process. Providing a railroad car properly equipped with cleaning material will effect a surface cleaning of the railroad tracks while the model train is being run around the tracks.

Track cleaning cars for model railroads are known in the art. For example, U.S. Pat. No. 2,475,771, issued to Murray Wittner on Jul. 12, 1949, depicts an attached piece of rolling stock on which is mounted felt pads at positions to correspond to the tracks. The Wittner track cleaning car is weighted to effect a cleaning of the top surface of the tracks. In U.S.Pat. No. 3,103,897, issued to Joseph Bonanno, et al on Sep. 17, 1963, and a corresponding U.S. Design Pat. No. 185,107, issued to Kenneth Van Dyck on May 8, 1959, provides a centrally positioned cleaning member that spans across the tracks. This cleaning member can be absorbent material or gritty material for roughening the top surface of the tracks.

In U.S.Pat. No. 5,816,168, issued to Matthew Poissant on Oct. 6, 1998, the model railroad car is equipped with a pair of rotating brush elements, somewhat like a street sweeper to remove debris from the surface of the tracks. In U.S.Pat. No. 5,904,100, issued to Barry Findley, et al on May 18, 1999, a three-rail track system cleaning mechanism is disclosed with a fresh supply of cleaning material being dispensed from a roll carried by the railroad car so that the cleaning material itself does not get dirty as it is rolled across the surface of the tracks.

The cleaning of railroad tracks with specialty cars for accomplishing the desired task is reflected in representative patents from the previous century. For example, U.S.Pat. No. 50,634, issued to G. C. Sharp on Oct. 24, 1865, and U.S.Pat. No. 195,217, issued to M. C. Isaacs on Sep. 18, 1877, are directed to brushes that are mounted on railroad cars for cleaning and clearing the tracks of dirt and debris. In the Isaacs patent, the brushes are retractable to permit selective engagement thereof. German Patent No. DE 28 01 111, granted on Mar. 15, 1979, is also directed to a cleaning device for effecting the cleaning of the top surface of a railroad track on which the car is traversing.

It is desirable to provide a model railroad car that will be operable to clean the top surface of the model railroad tracks as the car is being run around the tracks. The cleaning element being rubbed against the top surface of the tracks would be most effective if a tensioning element could vary the pressure exerted on the cleaning element and provide a coupling between the truck bearing the wheels and cleaning element to assist in the cleaning element following the truck around curves in the track.

SUMMARY OF THE INVENTION

It is an object of this invention to overcome the aforementioned disadvantages of the known prior art by providing a railroad track cleaning car having a weighted cleaning member suspended from a framework connected to fore-and-aft positioned trucks.

It is another object of this invention to provide a retaining wire interconnecting the truck and a articulating arm to which is mounted the cleaning element to force the articulating arm to move with the truck around curves in the track.

It is a feature of this invention that the railroad track cleaning car is provided with a spring pressure apparatus to vary selectively the spring pressure exerted on the cleaning element It is an advantage of this invention that the cleaning element will clean the top surface of the model railroad track as the train in which the track cleaning car is attached runs across the track.

It is another feature of this invention that a retaining wire is clipped to a articulating arm and engaged with the truck to which the articulating arm is mounted so that the articulating arm will follow the movements of the truck.

It is another advantage of this invention that the cleaning element is maintained in engagement with the model railroad track even around curves.

It is still another advantage of this invention that the cleaning element is abrasive and scours the top surface of the model railroad tracks.

It is still another feature of this invention that the abrasive material on the weighted cleaning element is easily replaced.

It is yet another feature of this invention that the spring pressure adjustment mechanism includes a locking cap that engages the articulating arm to lock the selected spring pressure applied to the cleaning element.

It is yet another advantage of this invention that the cleaning element is suspended between a pair of trucks to support the cleaning element over the model railroad tracks.

It is a further advantage of this invention that the articulating arm interconnecting the truck and cleaning element is guided with the truck to keep the cleaning element over the model railroad tracks while traversing curves in the track.

It is yet another object of this invention to provide a model railroad track cleaning car that is durable in construction, inexpensive of manufacture, carefree of maintenance, facile in assemblage, and simple and effective in use.

These and other objects, features and advantages are accomplished according to the instant invention by providing a model railroad track cleaning car having a cleaning element suspended between a pair of wheeled trucks. The cleaning element is an abrasive material that is affixed to the underside of a weighted chassis that is suspended from a pair of articulating arms connected to the respective wheeled trucks. The cleaning material is easily replaced by removing a pair of fasteners from the chassis. A spring tension apparatus is positioned between the articulating arm and the cleaning element chassis to selectively position the cleaning element over the model railroad tracks. A retaining wire is captured in the articulating arm and engages the corresponding truck to turn the articulating arm with the truck, thus positioning the cleaning element over the model railroad tracks even when traversing a curve. A thumb wheel is formed with a notch that receives the articulating arm to lock the thumb wheel into a selected position.

BRIEF DESCRIPTION OF THE DRAWINGS

The advantages of this invention will become apparent upon consideration of the following detailed disclosure of the invention, especially when taken in conjunction with the accompanying drawings wherein:

FIG. 3 is a elevational end view of the model railroad track cleaning car depicted in FIGS. 1 and 2;

FIG. 4 is an enlarged cross-sectional detail view of the tension adjustment locking cap corresponding to lines 4—4 of FIG. 1;

FIG. 5 is an elevational detail view of the tension adjusting locking cap corresponding to lines 5—5 of FIG. 4;

DETAILED DESCRIPTION OF THE PREFERRED EMBODIMENT

Figure 1:
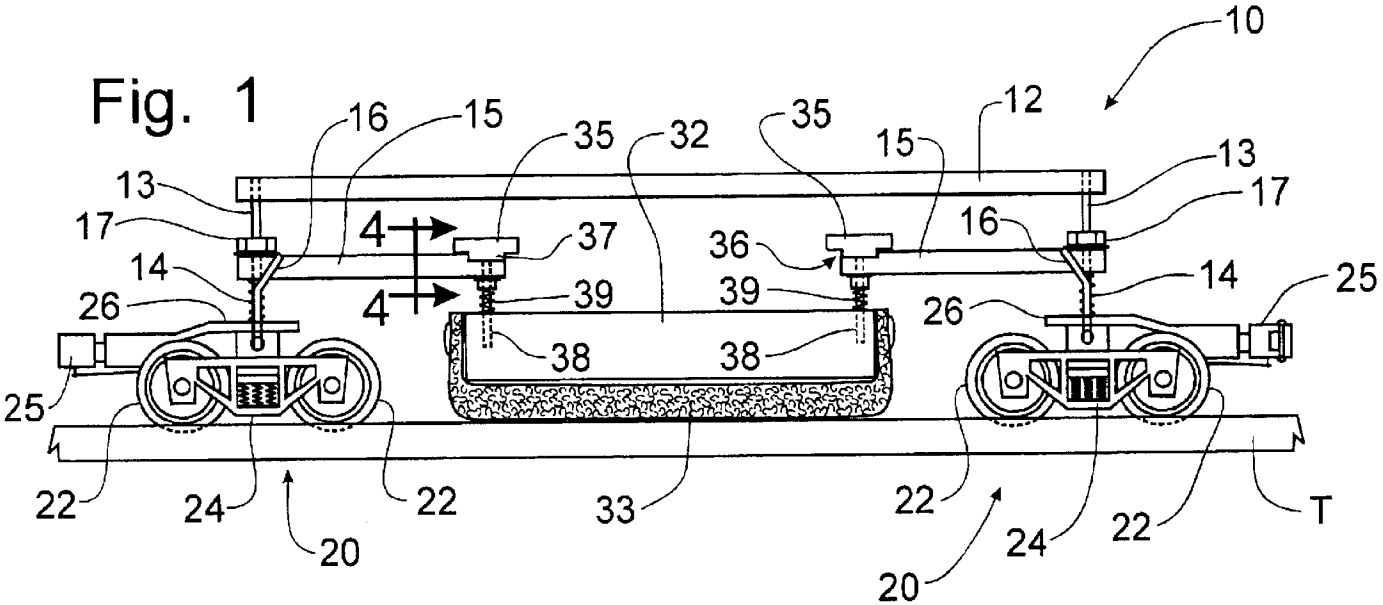
FIG. 1 is a side elevational view of a model railroad track cleaning car incorporating the principles of the instant invention.
Figure 2:
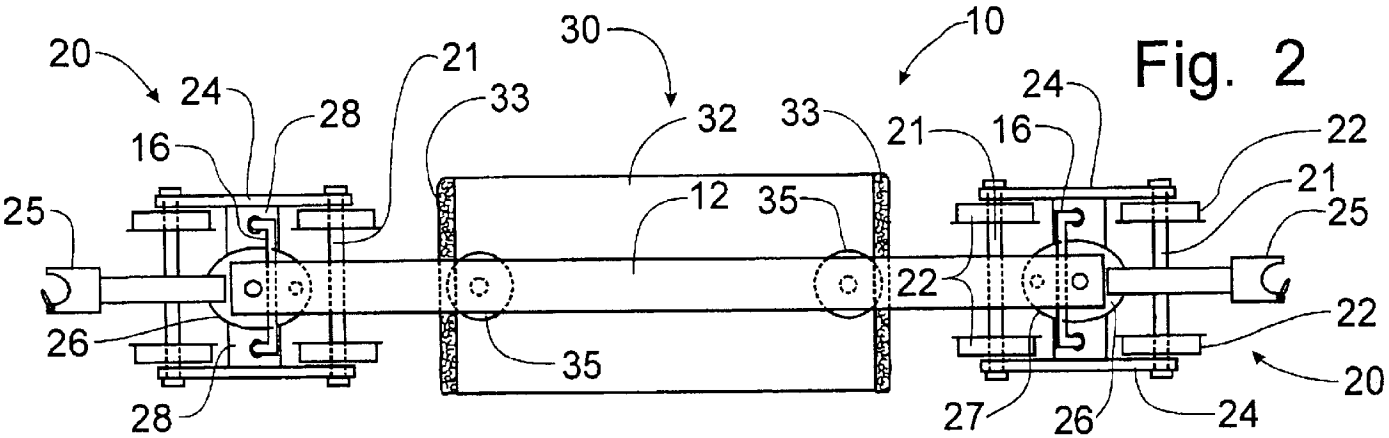
FIG. 2 is a top plan view of the model railroad track cleaning car shown in FIG. 1.
Figure 6:
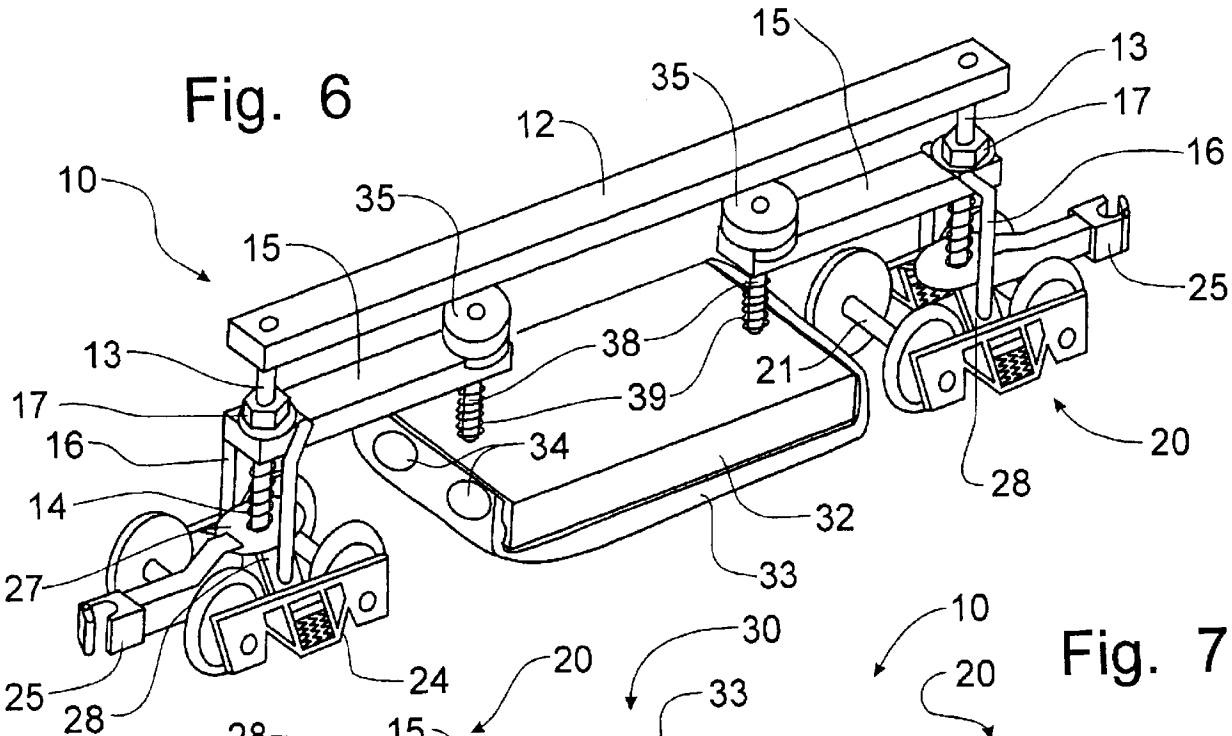
FIG. 6 is a perspective view of the model railroad track cleaning car of FIGS. 1–3.

Referring to FIGS. 1–7, a model railroad track cleaning car incorporating the principles of the instant invention can best be seen. The track cleaning car 10 is supported on the model railroad tracks T by a pair of longitudinally spaced standard wheeled railroad trucks 20. Each wheeled railroad truck 20 includes a pair of longitudinally spaced axles 21, each of which has a wheel 22 mounted on the opposing transverse ends thereof. The axles 21 are interconnected by a fore-and-aft extending side frame 24 imitating the spring suspension of a full scale railroad truck. Each railroad truck 20 is also provided with a standard model railroad coupler 25 that is preferably formed as part of a central truck bolster 26. The central truck bolster 26 includes a central bolster table 27 that is connected to each opposing side frame 24 by a side bolster member 28.

Figure 7:
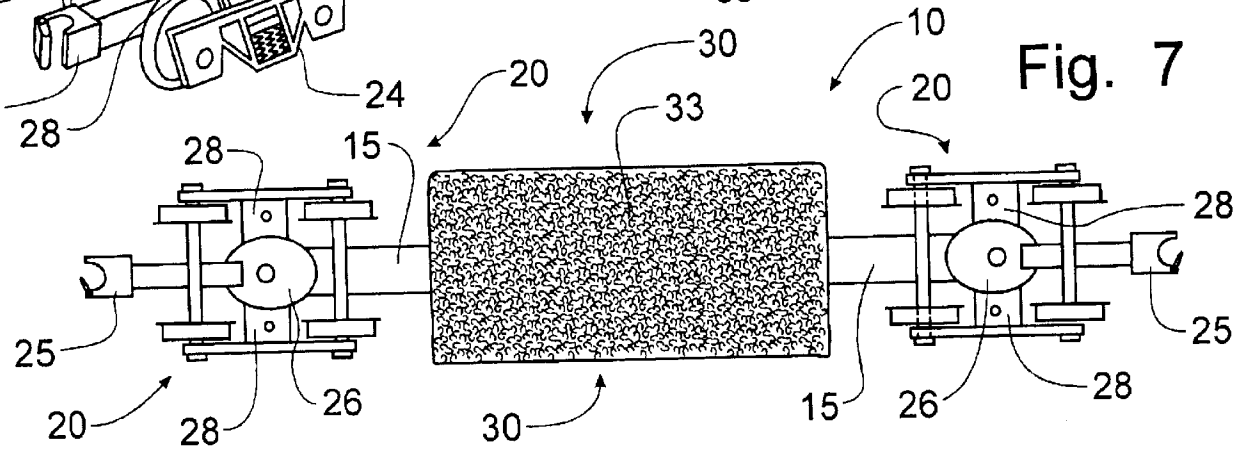
FIG. 7 is a bottom plan view of the model railroad track cleaning car looking from the opposite direction from the view of FIG. 2.

A cleaning member 30 is positioned between the two longitudinally spaced standard railroad trucks 20. The cleaning member 30 includes a weighted cleaning block 32, preferably formed of steel to provide sufficient weight for scouring the top surface of the model railroad tracks, as will be described in greater detail below. An abrasive cleaning material 33, such as Bear-Tex woven fiber polishing pad, is affixed to the ends of the cleaning block 32 by nylon expansion plugs 34 that can be removed from the cleaning block 32 to permit a replacement of the cleaning material 33. The cleaning material 33 wraps from one end of the cleaning block 32 around the bottom surface, as best seen in FIG. 7, and is affixed at the opposing end of the cleaning block 32 by an additional set of nylon expansion plugs 34. In operation, the cleaning material 33 is rubbed across the top of the model railroad tracks T with the weight of the cleaning block 32 pressing the cleaning material 33 onto the top surface of the tracks T. In this manner, the top surface of the tracks T is cleaned as the car 10 is moved around the circuit formed by the tracks T.

A main frame member 12 is connected to each railroad truck 20 by a threaded rod or bolt 13 extending generally vertically from the overhead frame member 12 to the respective central bolster table 27. An articulating arm 15 is located between the overhead main frame member 12 and the respective railroad truck 20 and connected via the threaded rod or bolt 13. The articulating arm 15 and the main frame member 12 are independently movable with respect to one another on the bolt 13. The bolt 13 is supported on the railroad truck 20 by a spring 14 so that the railroad truck 20 is vertically movable relative to the articulating arm 15. A head 13*a* placed on the threaded rod or bolt 13 below the planar central bolster table 27 prevents the railroad truck 20 from separating off the bolt 13. The main frame member 12 is threaded onto the bolt 13 to be movable on the threads of the bolt 13 to permit relative movement with respect to the articulating arm 15 and to the railroad truck 20.

The railroad truck 20 is connected to the articulating arm 15 by a U-shaped retaining wire 16 that is captured by a lock nut 17 threaded onto the bolt 13 against the articulating arm 15, thus fixing the articulating arm to the bolt 13 and to the retaining wire 16. Preferably, the retaining wire 16 is recessed within a slot formed in the articulating arm 15 so that the lock nut 17 rides flush on the top of the articulating arm 15. Accordingly, the articulating arm 15 rotates with the railroad truck 20 as the railroad truck 20 follows curves in the track. The retaining wire 16 is received in the transversely opposing side bolster members 28 to be horizontally restrained in movement relative to the railroad truck 20. The railroad truck 20 is vertically movable relative to the retaining wire 16 to permit the spring 14 to compress.

The opposing end of the articulating arm 15 is connected to the cleaning member cleaning block 32 by a second threaded rod or bolt 38 that is preferably threaded into the weighted cleaning block 32. A spring 39 is concentrically mounted on the second bolt 38 to be captured between the underside of the articulating arm 15 and the top of the cleaning block 32. An adjustor thumb wheel 35 is affixed to the top of the second bolt 38 to effect rotation of the second bolt 38 relative to the cleaning block 32 to adjust the compression of the spring 39, thus asserting a spring force on the cleaning block 32 in addition to the weight of the chassis pressing the cleaning material 33 onto the top surface of the tracks T. The adjusting thumb wheel 35 is notched to a width to receive the articulating arm 15 so that the thumb wheel 35 has downwardly extending sides 37 positioned on the outside of the articulating arm 15. The engagement of the articulating arm 15 into the notch 36 formed in the thumb wheel 35 prevents the thumb wheel 35 from being rotated, thus locking the selected compression of the spring 39 against the cleaning block 32.

Figure 8:
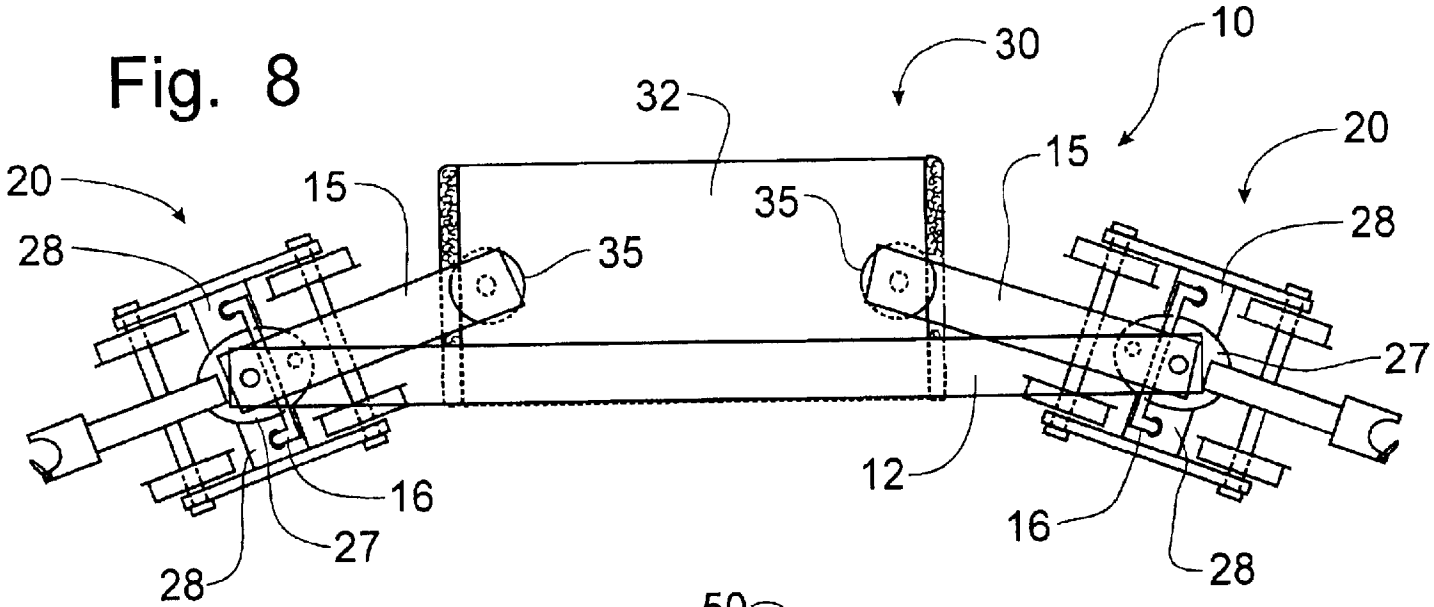
FIG. 8 is a top plan view of the track cleaning car similar to that of FIG. 2, but with the railroad trucks turned as would occur when the car is following a curve in the track layout.

The hole (not shown) formed in the end of the articulating arm 15 above the cleaning block 32 is formed as a slot to permit a fore-and-aft movement of the bolt 38 within the slot to allow articulation of the arm 15, cleaning block 32 and railroad truck 20. Because of this articulating movement, the car 10 is capable of traversing curves in the track layout, as is represented in FIG. 8, while staying substantially centered on the railroad tracks T around the curve. The articulation is effected by the railroad truck 20 going around the turn effecting a turning of the retaining wire 16 and a resulting turning of the articulating arm 15, thus moving the corresponding end of the cleaning block 32 with the articulating arm 15. The overhead main frame member 12 is limited in its turning movement due to the connection thereof with the other railroad truck 20; however, the main frame 12 will span between the two railroad trucks 20 as the car 10 traverses around the curve in the tracks T. The retaining wire 16, being restrained horizontally by the side bolster members 28 of the railroad truck 20, turns with the railroad truck 20 and, therefore, forces the articulating arm 15 to turn with the truck 20 around the curves in the track layout.

Figure 9:
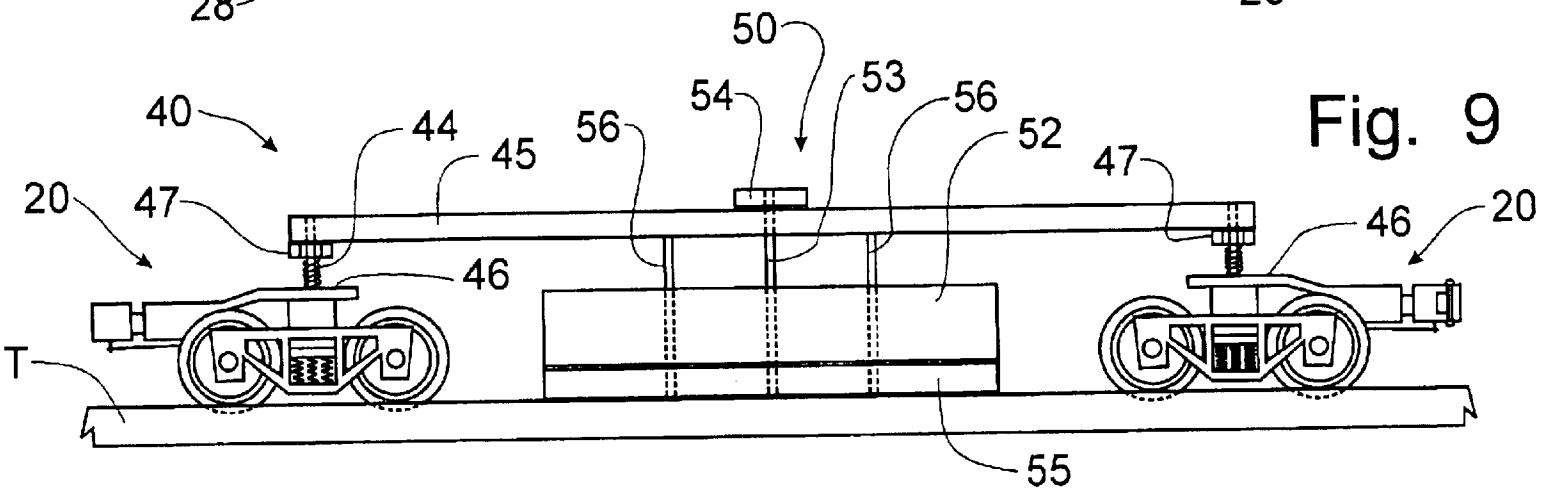
FIG. 9 is a side elevational view of an alternative embodiment of a model railroad track cleaning car corresponding to a smaller scale model than the embodiment of FIGS. 1–8.

Referring now to FIG. 9, an alternative embodiment of the model railroad track cleaning car 40 can be seen. The embodiment depicted in FIGS. 1–8 is best placed in the larger scale model railroads, such as the "O" scale. The smaller scale model railroads, such as the "HO" scale, do not possess the spatial requirements that will permit the more complex (and heavier) structure depicted in FIGS. 1–8. Accordingly, a simplified track cleaning car 40 includes a main frame member 45 that spans between the two railroad trucks 20. As with the embodiment of FIGS. 1–8, a spring 44 supports the end of the main frame member 45 above the central truck bolster 46 of the railroad truck 20. A lock nut 47 threaded onto the threaded rod or bolt 43 provides adjustment of the spring tension between the main frame member 45 and the railroad truck 20.

The cleaning member 50 is centrally suspended from the main frame member 45 between two railroad trucks 20 by a first threaded rod or bolt 53 threaded into the cleaning block 52. The bolt 53 has an adjusting thumb wheel 54 affixed to the top thereof above the main frame member 45. Manipulation of thumb wheel 54 varies the height of the cleaning block 52 and the attached abrasive member 55. While a spring mechanism can be optionally provided on the threaded rod or bolt 43, preferably, the only force applied to the abrasive member 55 is the weight of the cleaning block 52. To stabilize the orientation of the cleaning member 50, a pair of longitudinally spaced stabilizer pins are attached to the main frame member 45 to the opposing sides of the bolt 53 and received through openings formed in the cleaning block 52 and the abrasive member 55. Preferably, the abrasive member 55 is glued to the cleaning block 52 to provide a firm attachment therebetween.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A model railroad track cleaning car for cleaning a top surface of model railroad tracks comprising:

a pair of longitudinally spaced wheeled railroad trucks;

a main frame member interconnecting the railroad trucks and being connected to each respective railroad truck by a rod positioned at each respective corresponding end of said main frame member;

a cleaning member engagable with said tracks to rub against said top surface as said cleaning member is moved along said tracks;

an articulating arm mounted on each said rod and connected to a corresponding end of said cleaning member, each said articulating arm being movable in a generally horizontal plane about said rod independently of said main frame member; and a retainer member interconnecting each said railroad trucks and the corresponding said articulating arm to cause said articulating arm to move with the corresponding said railroad truck relative to said main frame member.

2. The model railroad track cleaning car of claim 1 wherein said retainer member is fixed to the corresponding said articulating arm.

3. The model railroad track cleaning car of claim 2 wherein said retainer member is formed from wire and is captured in a slot formed in the corresponding said articulating arm by a lock member supported against said articulating arm.

4. The model railroad track cleaning car of claim 3 wherein said lock member supported against said articulating arm is a nut threaded onto said rod against said articulating arm.

5. The model railroad track cleaning car of claim 4 wherein said second spring mechanism includes:

a second rod threaded into said cleaning member and engaged with said articulating arm;

a thumb wheel affixed to said second rod and positioned on top of said articulating arm, said thumb wheel being operable to rotate said second rod; and a second spring member concentrically mounted on said second rod between said articulating arm and said cleaning member, the rotation of said second rod effecting translational movement of said second rod relative to said cleaning member to compress said second spring member.

6. The model railroad track cleaning car of claim 5 wherein said thumb wheel is notched to receive said articulating arm so that a seating of said thumb wheel on said articulating arm with said articulating arm received within said notch prevents said thumb wheel from being rotated.

7. The model railroad track cleaning car of claim 2 wherein said retainer member is received in the corresponding said railroad truck and restricted against horizontal movement relative to said railroad truck.

8. The model railroad track cleaning car of claim 7 wherein said railroad truck is vertically movable relative to said retainer member.

9. The model railroad track cleaning car of claim 8 further comprising:

a first spring mechanism positioned between said articulating arm and the corresponding said railroad truck; and a second spring mechanism positioned between said articulating arm and said cleaning member.

10. In a model railroad track cleaning car for cleaning a top surface of model railroad tracks, said model railroad track cleaning car having a pair of longitudinally spaced wheeled railroad trucks; a main frame member interconnecting the railroad trucks and being connected to each respective railroad truck by a rod positioned at each respective corresponding end of said main frame member; and a cleaning member operatively connected to said main frame member and being engagable with said tracks to rub against said top surface as said cleaning member is moved along said tracks, the improvement comprising:

an articulating arm mounted on each said rod and connected to a corresponding end of said cleaning member, each said articulating arm being movable about the corresponding said rod independently of said main frame member; and a retainer member interconnecting each said railroad trucks and the corresponding said articulating arm to cause said articulating arm to move with the corresponding said railroad truck relative to said main frame member.

11. The model railroad track cleaning car of claim 10 wherein said retainer member is received in the corresponding said railroad truck and restricted against horizontal movement relative to said railroad truck, said railroad truck being vertically movable relative to said retainer member.

12. The model railroad track cleaning car of claim 11 wherein said retainer member is formed from wire and is captured in a slot formed in the corresponding said articulating arm by a nut threaded onto said rod against said articulating arm.

13. The model railroad track cleaning car of claim 12 further comprising a spring mechanism positioned between said articulating arm and said cleaning member, including:

a second rod threaded into said cleaning member and engaged with said articulating arm;

a thumb wheel affixed to said second rod and positioned on top of said articulating arm, said thumb wheel being operable to rotate said second rod; and a spring member concentrically mounted on said second rod between said articulating arm and said cleaning member, the rotation of said second rod effecting translational movement of said second rod relative to said cleaning member to compress said spring member.

14. A model railroad track cleaning car for cleaning a top surface of model railroad tracks, comprising:

a frame apparatus interconnecting a pair of longitudinally spaced railroad trucks;

a cleaning member operatively connected to said main frame member and being engagable with said tracks to rub against said top surface as said cleaning member is moved along said tracks;

a connecting rod threaded into said cleaning member and engaged with said frame apparatus; and a thumb wheel affixed to said connecting rod and positioned on top of said frame apparatus, said thumb wheel being operable to rotate said connecting rod, said thumb wheel being notched to receive said frame apparatus so that a seating of said thumb wheel on said frame apparatus with said frame apparatus received within said notch prevents said thumb wheel from being rotated.

15. The model railroad track cleaning car of claim 14 further comprising:

a spring member concentrically mounted on said second rod between said articulating arm and said cleaning member, the rotation of said second rod effecting translational movement of said second rod relative to said cleaning member to compress said spring member.

16. The model railroad track cleaning car of claim 14 wherein said frame apparatus comprises:

a main frame member interconnecting the railroad trucks and being connected to each respective railroad truck by a threaded rod positioned at each respective corresponding end of said main frame member;

an articulating arm mounted on each said threaded rod and connected to a corresponding end of said cleaning member, each said articulating arm being movable about the corresponding said threaded rod independently of said main frame member; and a retainer member interconnecting each said railroad truck and the corresponding said articulating arm to cause said articulating arm to move with the corresponding said railroad truck relative to said main frame member.

17. The model railroad track cleaning car of claim 16 wherein said retainer member is received in the corresponding said railroad truck and restricted against horizontal movement relative to said railroad truck, said railroad truck being vertically movable relative to said wire bale.

18. The model railroad track cleaning car of claim 16 wherein said retainer member is formed from wire and is captured in a slot formed in the corresponding said articulating arm by a nut threaded onto said rod against said articulating arm.

19. The model railroad track cleaning car of claim 14 further comprising:

a spring member concentrically mounted on said connecting rod between said articulating arm and said cleaning member, the rotation of said thumb wheel effecting translational movement of said connecting rod relative to said cleaning member to compress said spring member.

20. The model railroad track cleaning car of claim 19 further comprising:

a spring mechanism positioned between said articulating arm and the corresponding said railroad truck.

* * * * *